US007475948B2

(12) United States Patent
Hall et al.

(10) Patent No.: US 7,475,948 B2
(45) Date of Patent: Jan. 13, 2009

(54) PICK WITH A BEARING

(76) Inventors: David R. Hall, 2185 S. Larsen Pkwy., Provo, UT (US) 84606; Ronald B. Crockett, 2185 S. Larsen Pkwy., Provo, UT (US) 84606; Jeff Jepson, 2185 S. Larsen Pkwy., Provo, UT (US) 84606; Francis Leany, 2185 S. Larsen Pkwy., Provo, UT (US) 84606

( * ) Notice: Subject to any disclaimer, the term of this patent is extended or adjusted under 35 U.S.C. 154(b) by 1 day.

(21) Appl. No.: 11/742,304

(22) Filed: Apr. 30, 2007

(65) Prior Publication Data

US 2008/0036270 A1 Feb. 14, 2008

Related U.S. Application Data

(63) Continuation of application No. 11/742,261, filed on Apr. 30, 2007, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, which is a continuation-in-part of application No. 11/463,962, filed on Aug. 11, 2006, now Pat. No. 7,413,256, which is a continuation-in-part of application No. 11/463,953, filed on Aug. 11, 2006, said application No. 11/742,304 is a continuation-in-part of application No. 11/695,672, filed on Apr. 3, 2007, now Pat. No. 7,396,086, which is a continuation-in-part of application No. 11/686,831, filed on Mar. 15, 2007.

(51) Int. Cl.
*E21C 35/18* (2006.01)

(52) U.S. Cl. ..... 299/104; 299/110

(58) Field of Classification Search ..... 299/104, 299/110

See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk et al. |
| 3,254,392 | A | 6/1966 | Novkov |
| 3,746,396 | A | 7/1973 | Radd |
| 3,807,804 | A | 4/1974 | Kniff |
| 3,830,321 | A | 8/1974 | McKenry et al. |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |

(Continued)

*Primary Examiner*—John Kreck
(74) *Attorney, Agent, or Firm*—Tyson J. Wilde

(57) ABSTRACT

In one aspect of the invention, a degradation assembly comprises a holder. The holder is attached to a driving mechanism and comprises a longitudinal central bore. A pick comprises a body intermediate a shank and an impact tip, and the shank is disposed in the central bore of the holder. The impact tip comprises an impact surface diamond or cubic boron nitride. At least one rolling element is disposed intermediate an inner bore surface and the shank, and is adapted for low-friction rotation with respect to both the inner bore surface and the shank.

15 Claims, 10 Drawing Sheets

U.S. PATENT DOCUMENTS 4,098,362 A 7/1978 Bonnice
4,109,737 A 8/1978 Bovenkerk
4,156,329 A 5/1979 Daniels et al.
4,199,035 A 4/1980 Thompson
4,201,421 A 5/1980 Den Besten
4,277,106 A 7/1981 Sahley
4,439,250 A 3/1984 Acharya
4,465,221 A 8/1984 Schmidt
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,736,533 A * 4/1988 May et al. ..... 37/456
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund et al.
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor et al.
5,823,632 A 10/1998 Burkett
5,837,071 A 11/1998 Andersson et al.
5,845,547 A 12/1998 Sollami
5,875,862 A 3/1999 Jurewicz
5,934,542 A 8/1999 Nakamura
5,935,718 A 8/1999 Demo et al.
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson et al.
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 * 1/2002 Sollami ..... 299/110
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin
6,889,890 B2 5/2005 Yamazaki et al.
6,966,611 B1 11/2005 Sollami
6,994,404 B1 2/2006 Sollami
7,204,560 B2 4/2007 Mercier
2002/0175555 A1 11/2002 Mercier
2003/0137185 A1 * 7/2003 Sollami ..... 299/106
2003/0141350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

PICK WITH A BEARING

CROSS REFERENCE TO RELATED APPLICATIONS

This application is a continuation of U.S. patent application Ser. No. 11/742,261 which was filed on Apr. 30, 2007 and entitled Lubricated Pick. U.S. patent application Ser. No. 11/742,261 is a continuation in-part of U.S. patent application Ser. No. 11/464,008 which was filed on Aug. 11, 2006 now U.S. Pat. No. 7,338,135 and entitled Holder for a Degradation Assembly. U.S. patent application Ser. No. 11/464,008 is a continuation in-part of U.S. patent application Ser. No. 11/463,998 which was filed on Aug. 11, 2006 now U.S. Pat. No. 7,384,105 and entitled Washer for a Degradation Assembly. U.S. patent application Ser. No. 11/463,998 is a continuation in-part of U.S. patent application Ser. No. 11/463,990 which was filed on Aug. 11, 2006 now U.S. Pat. No. 7,320,505 and entitled An Attack Tool. U.S. patent application Ser. No. 11/463,990 is a continuation-in-part of U.S. patent application Ser. No. 11/463,975 which was filed on Aug. 11, 2006 and entitled An Attack Tool. U.S. patent application Ser. No. 11/463,975 is a continuation in-part of U.S. patent application Ser. No. 11/463,962 which was filed on Aug. 11, 2006 now U.S. Pat. No. 7,413,256 and entitled An Attack Tool. U.S. patent application Ser. No. 11/463,962 is a continuation-in-part of U.S. patent application Ser. No. 11/463,953, which was also filed on Aug. 11, 2006 and entitled An Attack Tool. The present application is also a continuation-in-part of U.S. patent application Ser. No. 11/695,672 which was filed on Apr. 3, 2007 now U.S. Pat. No. 7,396,086 and entitled Core for a Pick. U.S. patent application Ser. No. 11/695,672 is a continuation in-part of U.S. patent application Ser. No. 11/686,831 filed on Mar. 15, 2007 and entitled A Superhard Composite Material Bonded to a Steel Body. All of these applications are herein incorporated by reference for all that they contains.

BACKGROUND OF THE INVENTION

Efficient degradation of materials is important to a variety of industries including the asphalt, mining, construction, drilling, and excavation industries. In the asphalt industry, pavement may be degraded using picks, and in the mining industry, picks may be used to break minerals and rocks. Picks may also be used when excavating large amounts of hard materials. In asphalt milling, a drum supporting an array of picks may rotate such that the picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., U.S. Pat. No. 3,830,321 to McKenry et al., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

The picks typically have a tungsten carbide tip, which may last less than a day in hard milling operations. Consequently, many efforts have been made to extend the life of these picks. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, a degradation assembly comprises a holder. The holder is attached to a driving mechanism and comprises a longitudinal central bore. A pick comprises a body intermediate a shank and an impact tip, and the shank is disposed in the central bore of the holder. The impact tip comprises an impact surface comprising diamond or cubic boron nitride. A bearing assembly comprising at least one rolling element is disposed intermediate an inner bore surface and the shank.

The degradation assembly may be part of an asphalt milling machine, a trenching machine, a mining machine, or combinations thereof. The impact tip may be disposed on a carbide core that is press fit into a cavity in the body. The diamond may be polycrystalline diamond, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

The rolling element may be a roller bearing, a ball bearing, a needle bearing, spindle bearing, angular bearing, or combinations thereof.

The degradation assembly may comprise at least one bearing assembly secured between the shank and the bore of the holder. The bearing assembly may be press fit into the bore. The bearing assembly may be adapted to accommodate radial forces, axial forces, forces perpendicular to a main axis of the holder, or combinations thereof The bearing assembly may comprise a lubricant and the lubricant may be substantially retained within the bearing assembly. The bearing assembly may comprise a taper proximate an intersection of the body and the shank.

The shank may be retained in the holder by a spring-loaded protrusion in the bore of the holder, or by a resilient keeper ring. At least one seal assembly proximate the open end of the bore may substantially exclude degradation debris from contact with the rolling element. The seal assembly may comprise a washer, which is restricted from movement around a central axis of the pick by an o-ring or by a flexible elastomeric substance.

In another aspect of the invention, a pick holder comprises a longitudinal central bore with an opening at a distal end of the holder. The holder is attached to a driving mechanism at a proximal end of the holder and comprises a bearing assembly disposed within the central bore. The bearing assembly comprises a plurality of rolling elements disposed intermediate an outer diameter and an inner diameter. The bearing assembly is adapted to allow low-friction rotation with respect to the central bore of a shank disposed within the inner diameter.

In another aspect of the invention a degradation assembly comprises a holder attached to a driving mechanism and a longitudinal central bore. A pick comprises a body intermediate a shank and an impact tip, and the shank is disposed in the central bore of the holder. The impact tip comprises diamond or cubic boron nitride. A bearing assembly is disposed within the bore and around the shank and is adapted for low-friction rotation with respect to both the bore and the shank.

DETAILED DESCRIPTION OF THE INVENTION AND THE PREFERRED EMBODIMENT

Figure 1:
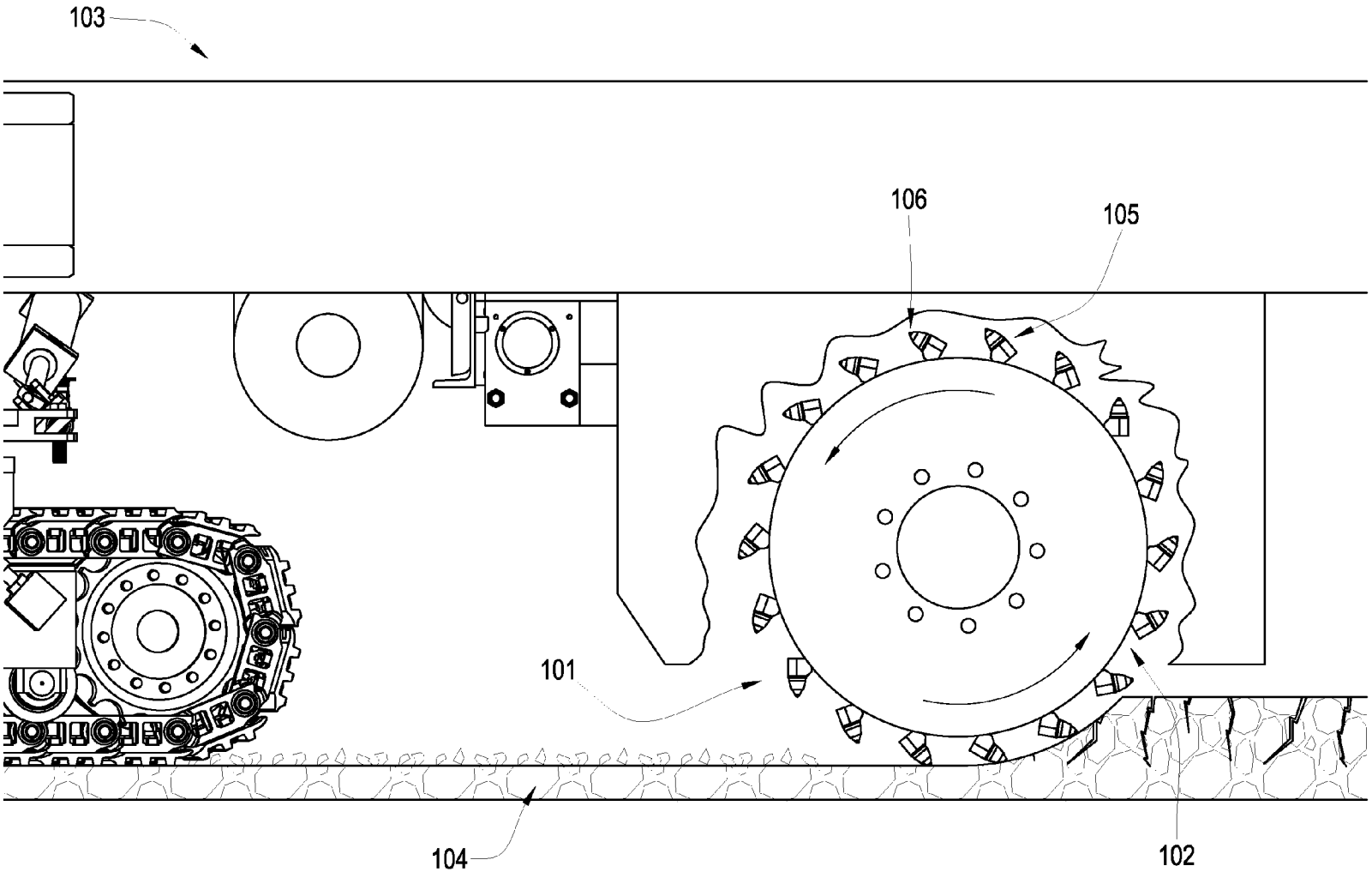
FIG. 1 is a cross-sectional diagram of an embodiment of a degradation assembly.

FIG. 1 is a cross-sectional diagram of an embodiment of a plurality of degradation assemblies 101 attached to a rotating drum 102 connected to the underside of a pavement recycling machine 103. The recycling machine 103 may be a cold planer used to degrade man-made formations such as pavement 104 prior to the placement of a new layer of pavement. Degradation assemblies 101 may be attached to the drum 102 at an angle, thereby bringing the degradation assemblies 101 into engagement with the formation 104 at the desired level of aggressiveness. A holder, may be a block 105 or an extension 201 (see FIG. 2) adapted for attachment to a block 105, and is attached to the rotating drum 102, and a pick 106 is inserted into the holder.

Figure 2:
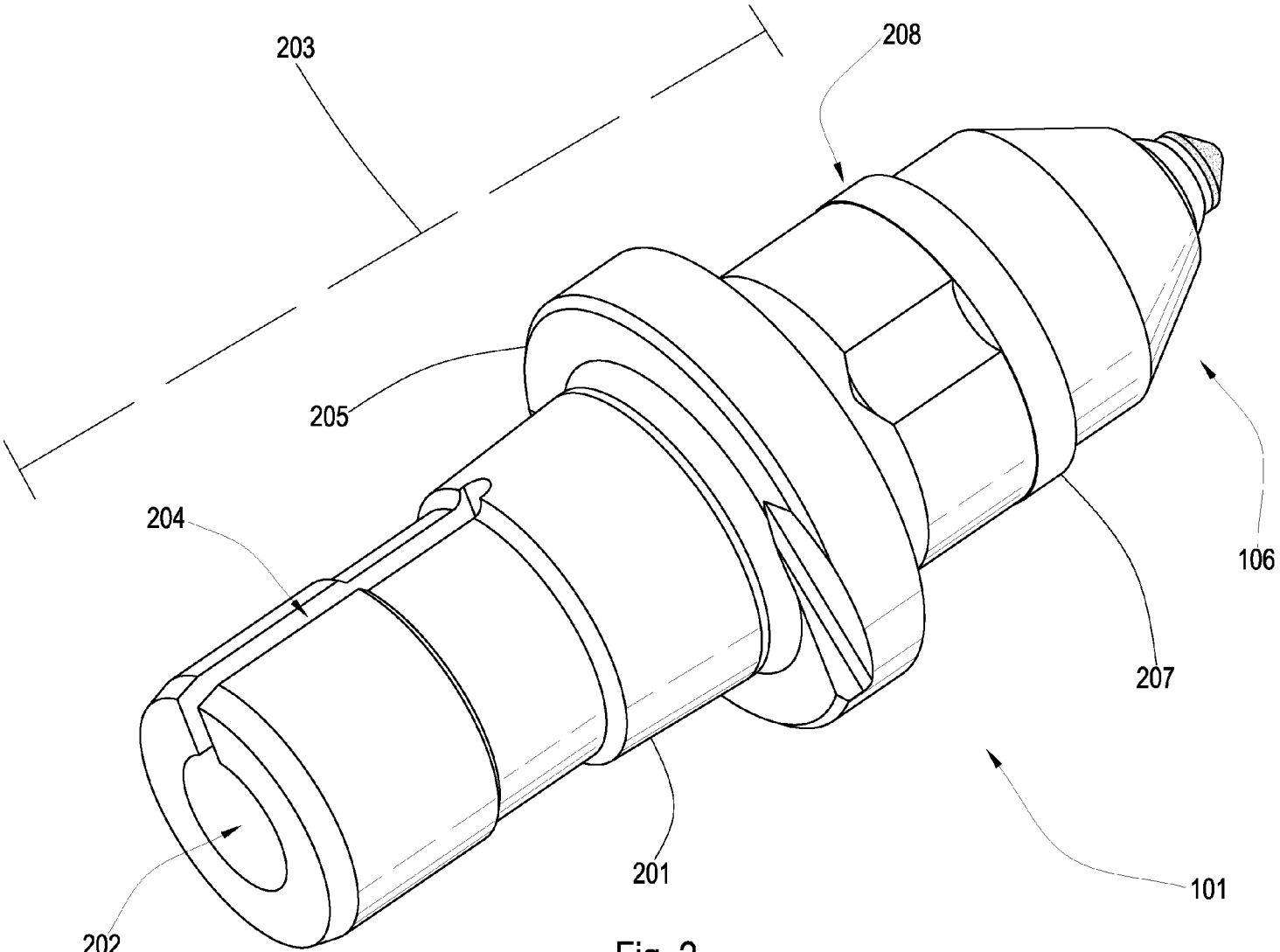
FIG. 2 is a perspective diagram of an embodiment of a pick in a holder.

FIG. 2 is a perspective diagram of an embodiment of a degradation assembly 101. The degradation assembly 101 comprises an extension 201. The extension 201 may be attached to the drum 102 through a block 105. The extension 201 comprises a longitudinal central bore 202, which may extend an entire length 203 of the extension 201. The extension 201 may comprise a slit 204 and/or a ledge 205 adapted to make the extension 201 complementary to the block 105. The degradation assembly 101 also comprises a pick 106 and a sacrificial washer 207. The pick 106 extends into a distal end 208 of the central bore 202 of the extension 201, thereby connecting the pick 106 and the extension 201.

Figure 2A:
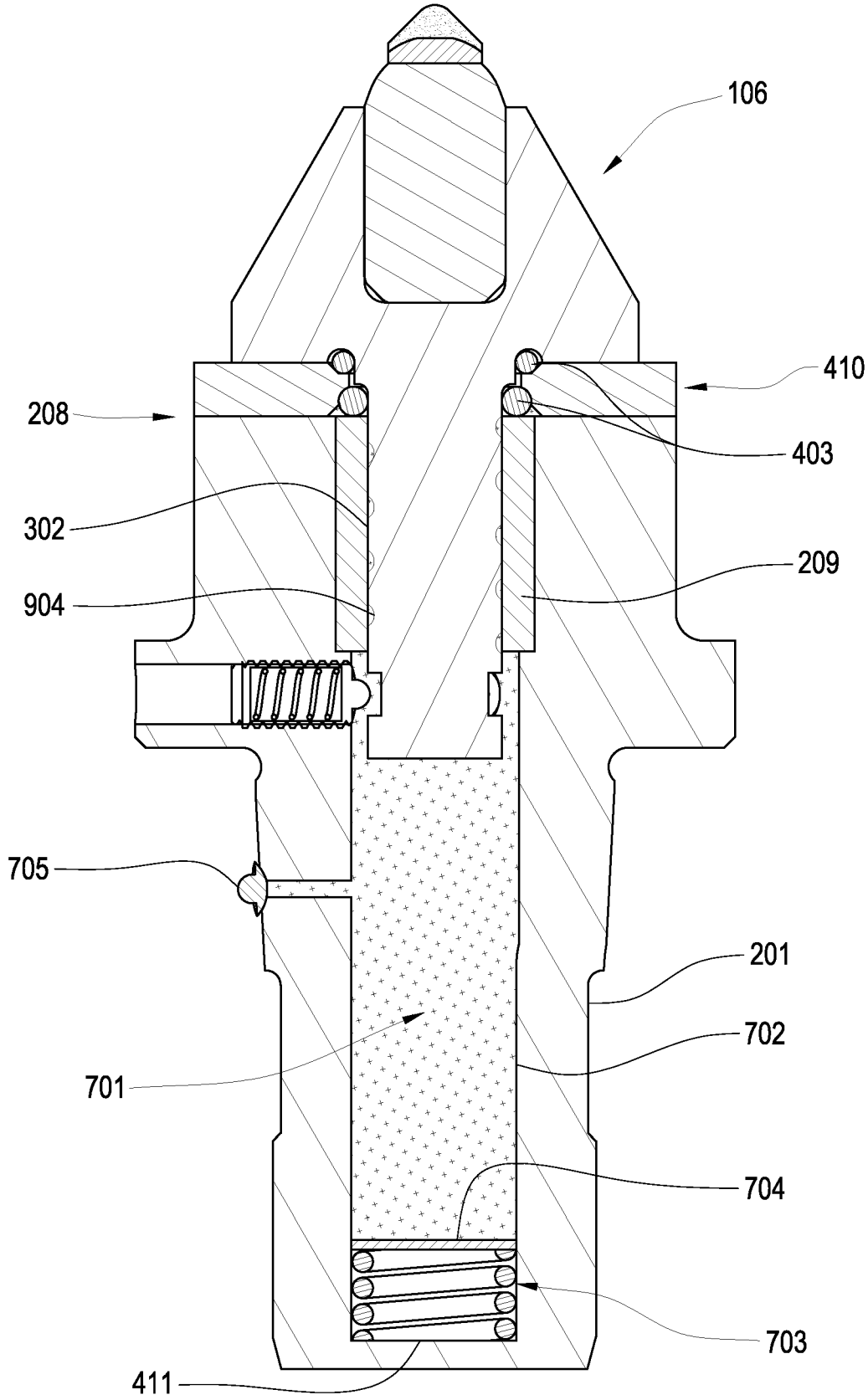
FIG. 2*a* is a cross-sectional diagram of an embodiment of a pick in a holder.

FIG. 2*a*, discloses a pick 106 disposed in the distal end 208 of an extension 201. As the degradation assembly 101 engages the formation 104, the pick 106 may be adapted to rotate within the extension 201. This is believed to cause the pick 106 to wear evenly and extend the life of the pick 106. If aggregate (not shown) accumulates between the pick 106 and the extension 201, this aggregate may increase friction between them and cause the pick 106 to cease rotation. A bushing 209 may be placed between the shank 302 and the extension 201 in order to allow for low-friction rotation of the shank 302 with respect to the extension 201. A lubricant 701 may be provided by a lubricating mechanism and may further facilitate low-friction rotation of the pick 106. The lubricant 701 may be substantially retained within the extension 201 with a seal assembly 404 by placing one or more O-rings 403 between the bushing 209 and the pick 106. The bushing 209 may comprise a cemented metal carbide material, a hardened steel, coated steel, metal bonded diamond particles, CVD or PVD diamond or cubic boron nitride. As disclosed in FIG. 2*a*, one or more grooves 904 may extend along the shank 302 in a spiral pattern. The spiral groove is believed to facilitate the transfer of lubricant 701 along the length 408 of the shank 302. The lubricating mechanism may comprise a reservoir, a spring, a port, a plunger or a combination thereof.

Figure 2B:
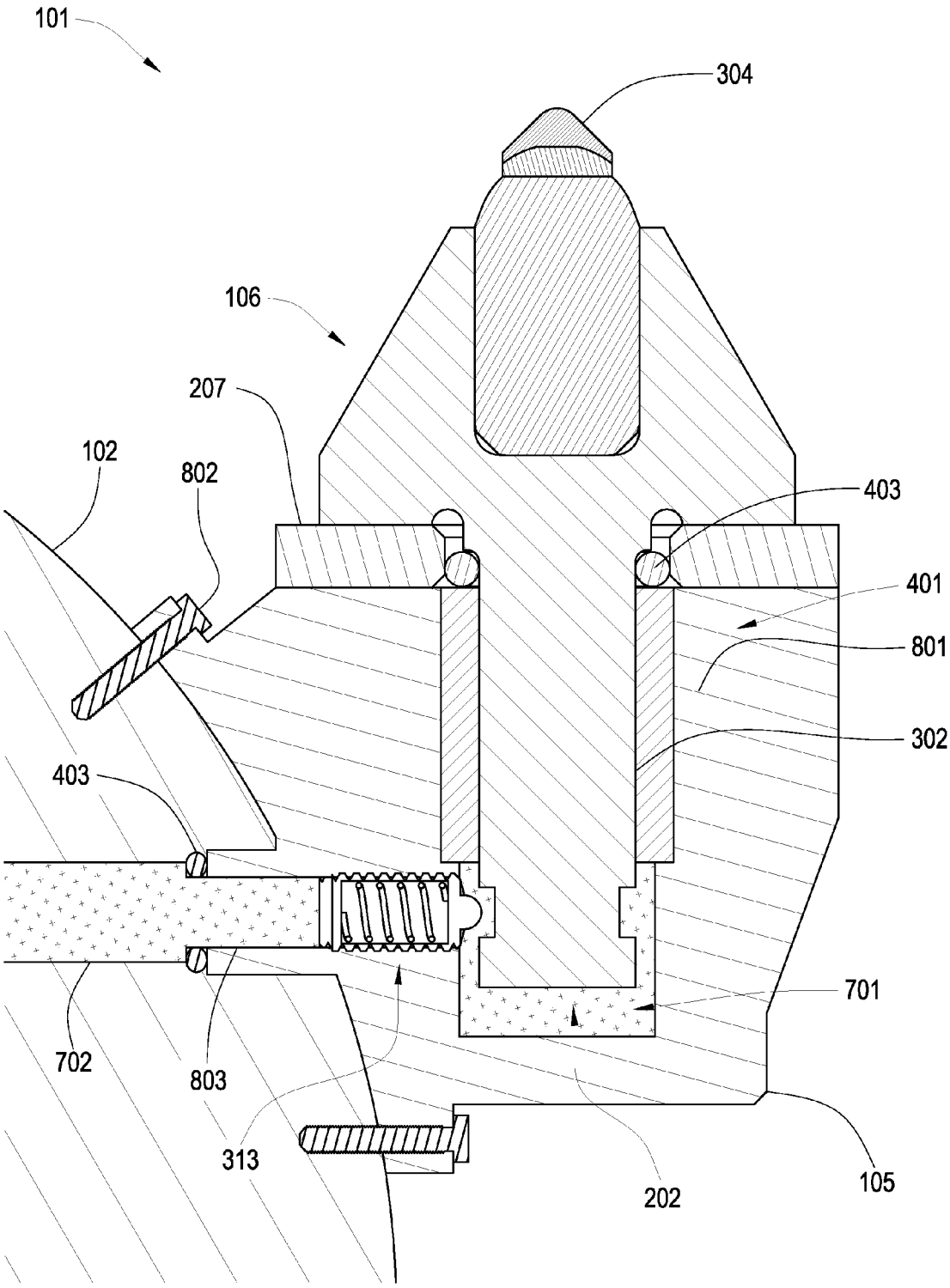
FIG. 2*b* is a cross-sectional diagram of another embodiment of a pick in a holder.

FIG. 2*b* discloses an embodiment of the invention where the holder is a block 105 that is attached directly to the drum 102 using bolts 802. Because of the wear resistance of the pick 106, shank 302 and holders due to the superhard impact surface 304, the bearing element 801 and/or bearing assembly 401, degradation assemblies 101 according to the current invention are believed to have dramatically increased life spans. In FIG. 2*b* the drum 102 comprises a lubricant reservoir 702. The reservoir 702 may comprise a channel 803 that extends from the reservoir 702 into the bore 202 of the block 105 or extension 201. The channel 803 may be disposed in or around a spring-loaded protrusion 313 disposed in the bore 202 of the block 105. An o-ring 403 may be disposed intermediate the reservoir 702 and the block 105, and/or between the washer 207 and the shank 302.

Figure 3:
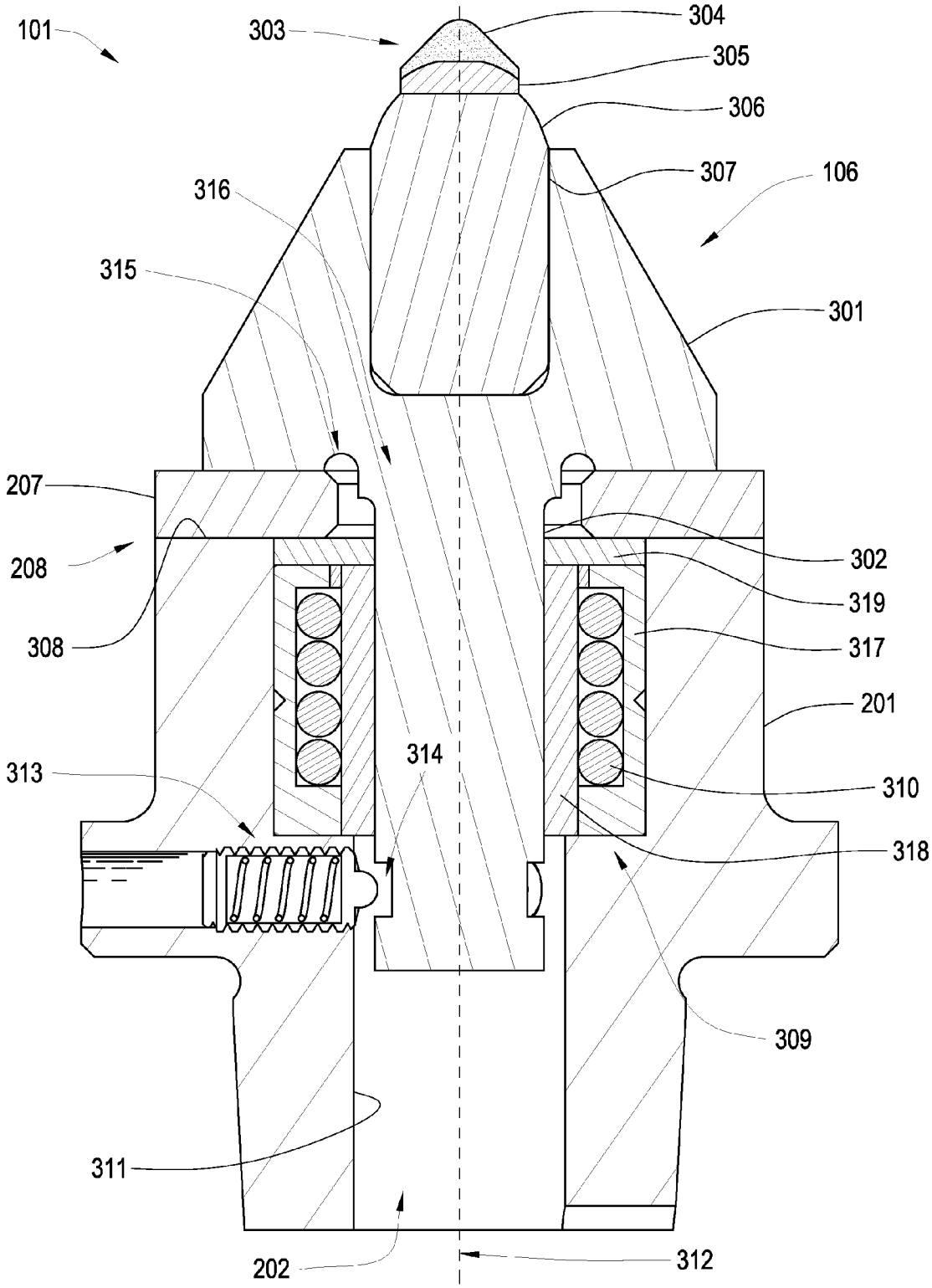
FIG. 3 is a cross-sectional diagram of another embodiment of a pick in a holder.

FIG. 3 discloses the pick 106 comprising a body 301, which is generally made of steel. The steel may be selected from the group consisting of 4140, EN30B, S7, A2, tool steel, hardened steel, alloy steels, and combinations thereof. The body 301 comprises a shank 302 and is attached to an impact tip 303. The impact tip 303 comprises an impact surface 304 with a hardness greater than 4000 HK.

The impact surface 304 may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof. The material may comprise a polycrystalline structure with an average grain size of 10 to 100 microns and in some embodiments the material may be at least 0.100 inches thick. In embodiments, where the material comprises a ceramic, the surface 304 may comprise a region that is free of binder material. Infiltrated diamond is typically made by sintering the material adjacent a cemented metal carbide substrate 305 and allowing a metal (such as cobalt) to infiltrate into the material.

The material may be bonded to the carbide substrate 305 through a high temperature high pressure process. During high temperature high pressure (HTHP) processing, some of the cobalt from the carbide substrate may infiltrate into the material such that the substrate 305 comprises a slightly lower cobalt concentration than before the HTHP process. The impact surface 304 may preferably comprise a 1 to 5 percent cobalt concentration by weight after the cobalt or other binder infiltrates the material The material may also comprise a 1 to 5 percent concentration of tantalum by weight. Other binders that may be used with the present invention include iron, cobalt, tungsten, nickel, silicon, carbonates, hydroxide, hydride, hydrate, phosphorus-oxide, phosphoric acid, carbonate, lanthanide, actinide, phosphate hydrate, hydrogen phosphate, phosphorus carbonate, alkali metals, ruthenium, rhodium, niobium, palladium, chromium, molybdenum, manganese, tantalum or combinations thereof. In some embodiments, the binder is added directly to the material's mixture before the HTHP processing so that sintering does not rely on the binder migrating from the substrate into the mixture. In some embodiments the impact tip 303 may be connected to a core 306 before the core is press fit into the body 301. Typically the substrate 305 of the impact tip 303 is brazed to the core 307 at a planar interface. The tip 303 and the core 306 may be brazed together with a braze comprising a melting temperature from 700 to 1200 degrees Celsius. In FIG. 3 the carbide substrate 305 is brazed to a carbide core 306, which is press fit into a cavity 307 in the body 301 of the pick 106. A radius on a press fit end of the core 306 may comprise a smaller diameter than the majority of the core 306. In some embodiments of the invention the carbide core 306 may be brazed into the cavity 307. Some picks 106 may comprise a carbide bolster attached at one end to the body 301 and at a second end to the impact tip 303. The impact tip 303 may be bonded directly to the bolster or to the carbide core 306.

The impact surface 304 may comprise a substantially pointed geometry with a sharp apex comprising a radius of 0.050 to 0.200 inches. In some embodiments, the radius is 0.090 to 0.110 inches. It is believed that the apex may be adapted to distribute impact forces, which may help to prevent the impact surface 304 from chipping or breaking. The material may comprise a thickness of 0.100 to 0.500 inches from the apex to an interface with the substrate 305, preferably from 0.125 to 0.275 inches. The material and the substrate 305 may comprise a total thickness of 0.200 to 0.700 inches from the apex to the core 306. The sharp apex may allow the high impact resistant pick 106 to more easily cleave asphalt, rock, or other formations.

The degradation assembly 101 of FIG. 3 comprises a plurality of bearing elements 310 disposed within a bearing assembly 309. The bearing assembly is secured between a shank 302 and the bore 202 of the extension 201. The plurality of bearing elements 310 is disposed intermediate an outer race 317 and an inner race 318. The outer race 317 may be press fit into the bore 202 and may be stationary with respect to the bore 202. The inner race 318 may be stationary with respect to the shank 302. Each bearing element 310 is adapted for low-friction rotation with respect to both the inner and outer races 318, 317. The bearing assembly 309 as a whole facilitates low-friction rotation of the shank 302 with respect to an inner surface 311 of the bore 202. The bearing assembly 309 may accommodate radial forces, axial forces, forces perpendicular to a main axis 312 of the extension 201, or combinations thereof. FIG. 3 discloses a plurality of ball bearing elements 310 disposed intermediate the inner bore surface 311 and the shank 302 and disposed in a bearing assembly 309. As disclosed in FIG. 3, the bearing assembly 309 may comprise one or more lids 319 at either end of the races 317, 318 in order to substantially enclose the bearing assembly 309.

The shank 302 may be coated with a hard surface. The hard surface may comprise a cemented metal carbide, chromium, manganese, nickel, titanium, silicon, hard surfacing, diamond, cubic boron nitride, polycrystalline diamond, diamond impregnated carbide, diamond impregnated matrix, silicon bonded diamond, deposited diamond, aluminum oxide, zircon, silicon carbide, whisker reinforced ceramics, nitride, stellite, or combinations thereof The hard surface may be bonded to the shank 302 through the processes of electroplating, cladding, electroless plating, thermal spraying, annealing, hard facing, applying high pressure, hot dipping, brazing, or combinations thereof. The hard surface may comprise a thickness of 0.001 to 0.200 inches. The hard surface may be polished.

The washer 207 is disposed intermediate the pick 106 and a distal surface 308 of the extension 201. It is believed that rotation of the pick 106 within the extension 201 causes the pick 106 to wear evenly. In embodiments with a sacrificial washer 207, the washer 207 prevents the body 301 of the pick 106 from rubbing against the distal surface 308 of the extension 201, which is believed to extend the working life of the extension 201. FIG. 3 also discloses a spring-loaded protrusion 313 disposed in the bore 202 of the extension 201. The protrusion 313 may retract when a shank 302 is inserted into the extension 201 and then spring into a recess 314 in the shank 302 when the recess 314 is proximate the protrusion 313, thus retaining the shank 302 within the bore in the extension 201. In some embodiments of the invention the shank 302 may be retained in the extension 201 by a resilient keep ring or snap ring.

A reentrant 315 may be formed on the shank 302 near and/or at a junction 316 of the shank 302 and the body 301. It is believed that placing the reentrant 315 near the junction 316 may relieve strain on the junction 316 caused by impact forces. The reentrant 315 may increase the flexibility of the junction 316. In some embodiments of the invention a plurality of reentrants 315 may be formed near the junction 316.

Figure 4:
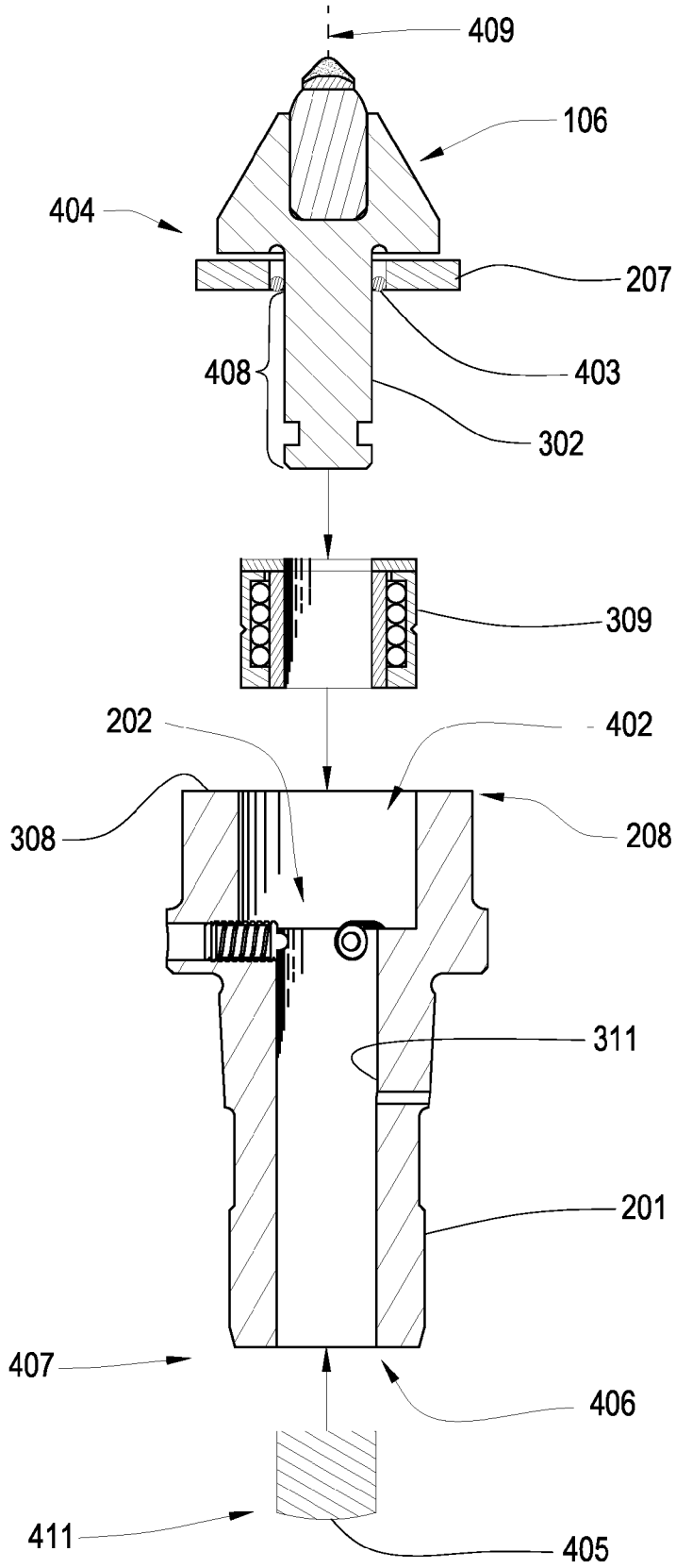
FIG. 4 is an exploded diagram of an embodiment of a pick and a holder.

Referring now to FIG. 4, an exploded view diagram discloses a bearing assembly 309 being fitted into an opening 402 of the bore 202 at the distal end 208 of the extension 201. A pick 106, a sacrificial washer 207, and an o-ring 403 make up a seal assembly 404 that is to be disposed proximate the opening 402 when the shank 302 is disposed within the bore 202. A cap 405 is press fit into a bore opening 406 proximate the driving mechanism (not shown). When the seal assembly 404 and bearing assembly 309 are fitted into the extension 201 at the distal end 208, and the cap is press fit into a proximal end 407, a length 408 of the shank 302 within the bore 202 is substantially sealed from degradation debris. By substantially sealing the length 408 of the shank 302 from degradation material, the degradation material may be substantially excluded from contact with the bearing element 310 or bearing assembly 309. In FIG. 4 a seal assembly 404 encloses the distal end 208 of the extension. A bearing assembly 309 may be disposed intermediate the seal assembly 404, and a proximal seal assembly 411. In the present embodiment the proximal seal assembly 411 comprises a cap 405. In some embodiments the proximal seal assembly 411 may comprise one or more O-rings 403. The contact of degradation material with the shank 302, bearing element 310, bearing assembly 309, or inner surface 311 of the bore 202 is believed to both increase the wear on these components and limit the rotation of the pick 106. The o-ring 403 or a flexible elastomeric substance may restrict the washer 207 from movement around a central axis 409 of the pick 106, thereby reducing wear on the distal surface 308 of the extension 201. In some embodiments of the invention the bearing assembly 309 may be press fit into the bore 202.

Figure 6:
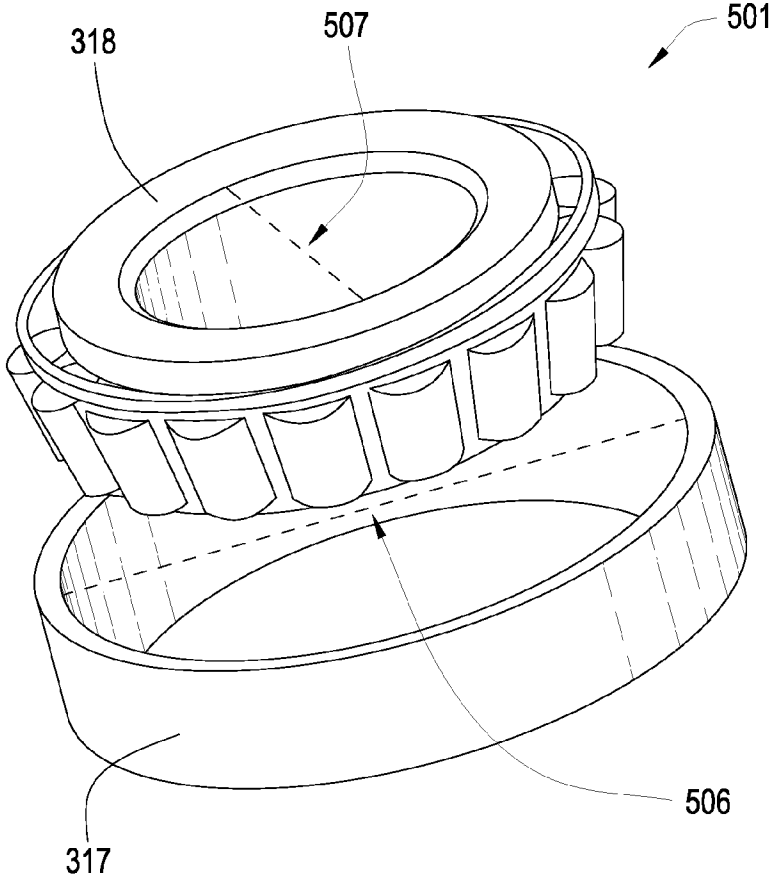
FIG. 6 is a perspective diagram of an embodiment of a bearing assembly
Figure 5:
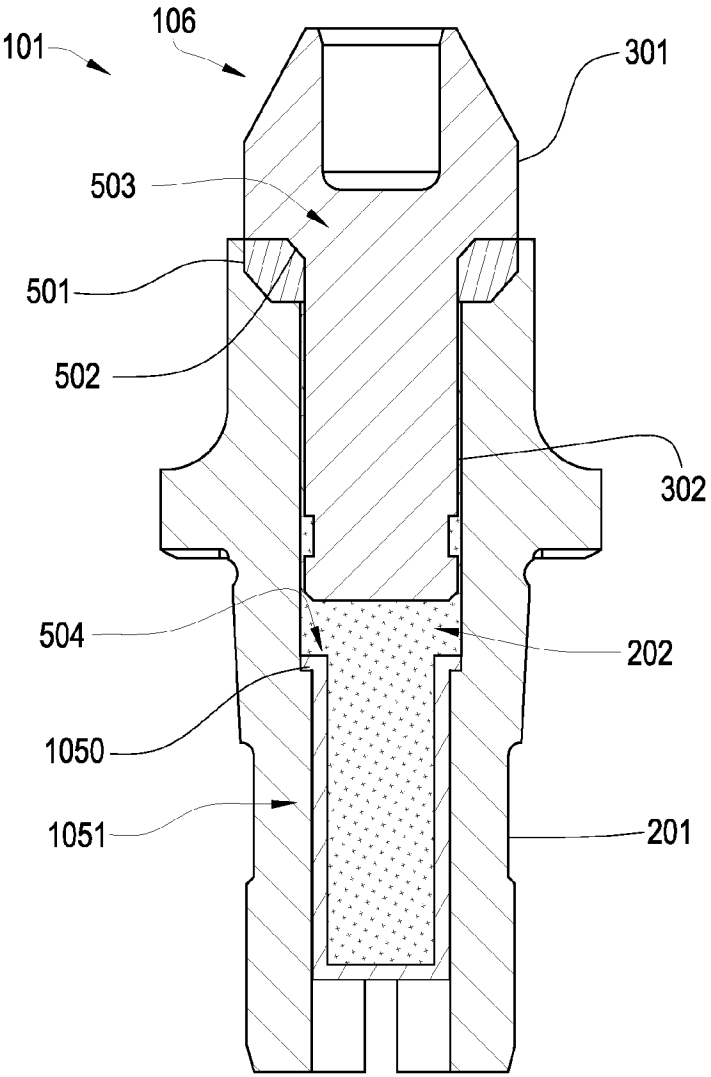
FIG. 5 is a cross-sectional diagram of another embodiment of a pick in a holder.

FIG. 5 discloses a degradation assembly 101 which comprises a taper bearing assembly 501. The assembly 501 comprises a taper 502 proximate a tapered junction 503 of the shank 302 and the body 301 of the pick 106. The extension 201 comprises a central bore 202 with a closed end 504 proximate the driving mechanism (not shown). In some embodiments, the closed end is formed in the holder, but in other embodiments a cap 1050 may be fitted in the bore. In the embodiment of FIG. 5, the cap comprises a pocket 1051, which provides a lubricant reservoir with a greater volume for providing more lubricant. FIG. 6 is a perspective diagram of a taper bearing assembly 501. The bearing assembly 501 comprises a plurality of roller bearing elements 505 disposed intermediate an outer diameter 506 and an inner diameter 507. The plurality of roller bearing elements 505 may be disposed intermediate outer and inner races 317, 318. Other types of bearing assemblies 309 may comprise a plurality of bearing elements 310 disposed intermediate outer and inner diameters 506, 507.

Figure 7:
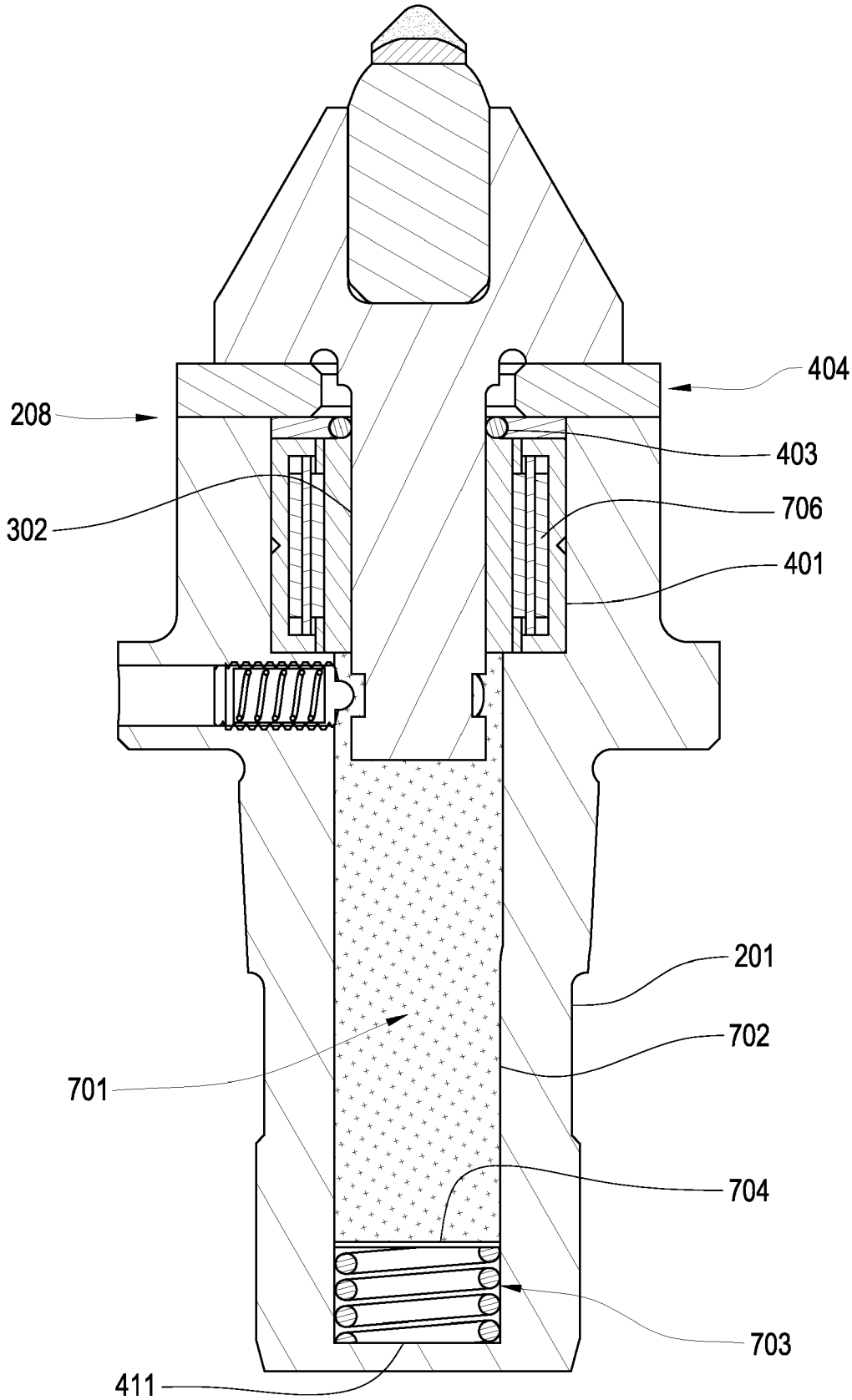
FIG. 7 is a cross-sectional diagram of another embodiment of a pick in a holder.

Referring now to FIG. 7, a bearing assembly 401 comprises a plurality of roller bearing elements 706. The bearing assembly 401 may comprise a lubricant 701. A supply of lubricant 701 may be replenished in and around the bearing assembly 401 and the shank 302 using a lubricant reservoir 702. The lubricant reservoir 702 may be pressurized in order to maintain a sufficient amount of lubricant 701 around the bearing assembly 401 and the shank 302. A resilient spring 703 attached to a plunger 704 may help to maintain the pressure in the reservoir 702 by pressurizing the lubricant 701 with a substantially constant force. The lubricant may be added to the reservoir through the bore retaining the shank prior to installation of the pick into the holder. The addition of the shank decreases the reservoir's volume and thereby increases the pressure in the reservoir. The lubricant 701 may be substantially retained around the shank 302 and bearing assembly 401 by being disposed intermediate the sealing assemblies 404, 411. An o-ring 403 disposed intermediate the bearing assembly 401 and the shank 302 near the distal end 208 of the extension 201 may substantially retain the lubricant 701 within the bearing assembly 401.

Figure 8:
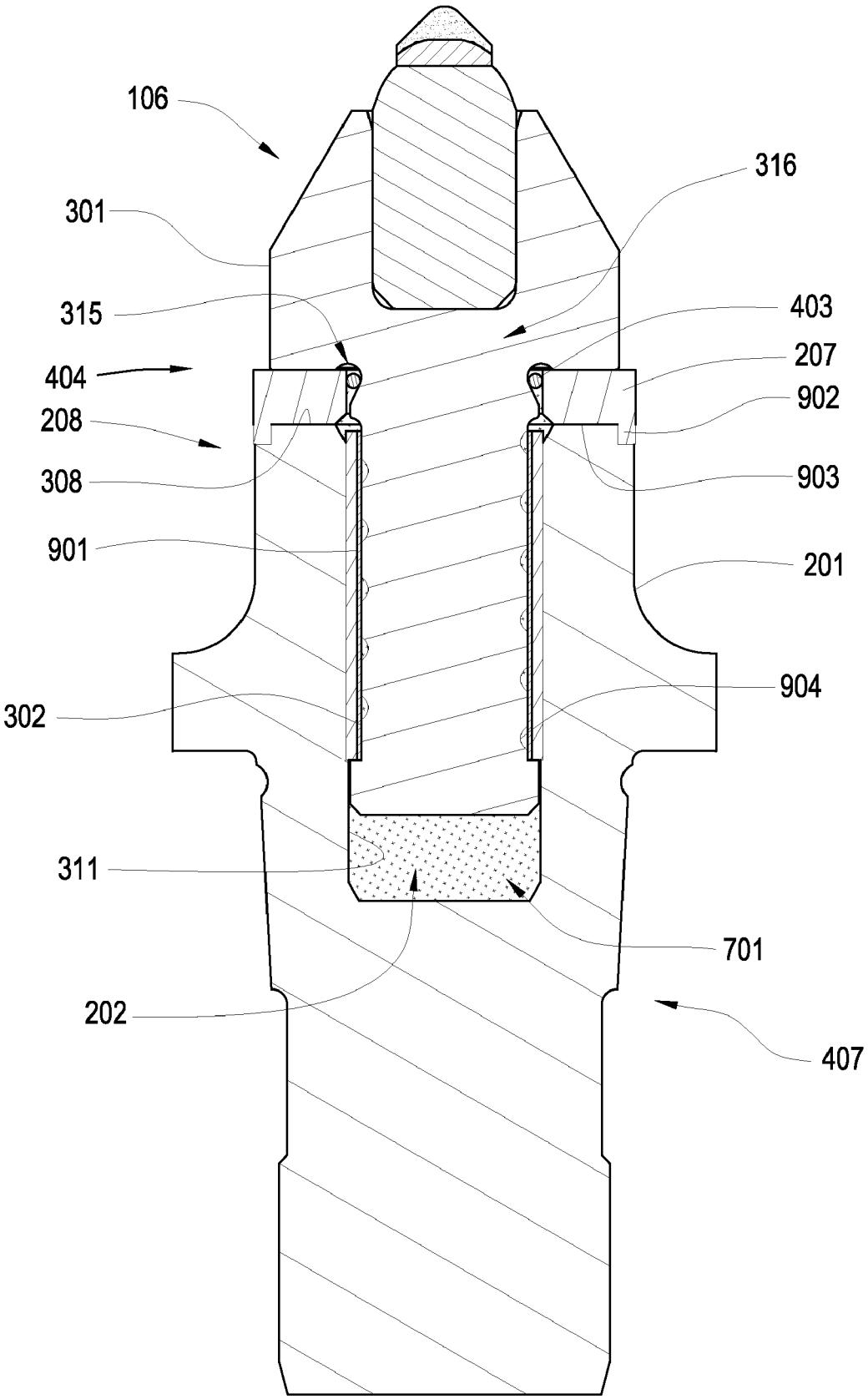
FIG. 8 is a cross-sectional diagram of another embodiment of a pick in a holder.

Referring now to FIG. 8, a bushing 901 is press fit into the bore 202 and is disposed between the shank 302 and the internal surface 311 of the bore 202. The proximal end 407 of the extension 201 is closed. The bushing 901 acts as a bearing element 310 to facilitate low-friction rotation between itself and the inner surface 311 and the shank 302. The seal assembly 404 comprises an o-ring 403 that is partially disposed in a reentrant 315 at the junction 316 of the body 301 and the shank 302 of the pick 106 at the distal end 208 of the extension 201. The seal assembly 404 may substantially limit the movement of the lubricant 701 that is disposed between the bushing 901 and the shank 302. In embodiments of the invention wherein a seal assembly 404 substantially retains the lubricant 701 within the bore 202, some lubricant 701 may pass through the seal assembly 404 and slowly extrude out the distal end 208 of the extension 201. The lubricant 701 may extrude between the washer 207 and the extension 201, and it may extrude between the body 301 of the pick 106 and the washer 207. A pin 902 may extend from the washer 207 into a recess in the distal end 208 of the extension 201. The pin 902 may reduce rotation of the washer 207 with respect to the extension 201, thereby reducing wear on the distal surface 308 of the extension 201. In some embodiments of the invention a lower surface 903 of the washer 207 may face the distal surface 308 of the extension and may comprise a rough surface. This rough surface may also reduce rotation of the washer 207.

In some embodiments of the invention, the lubrication mechanism is a bushing with graphite, or a laminated graphite, such as Graphfoil®.

Figure 9:
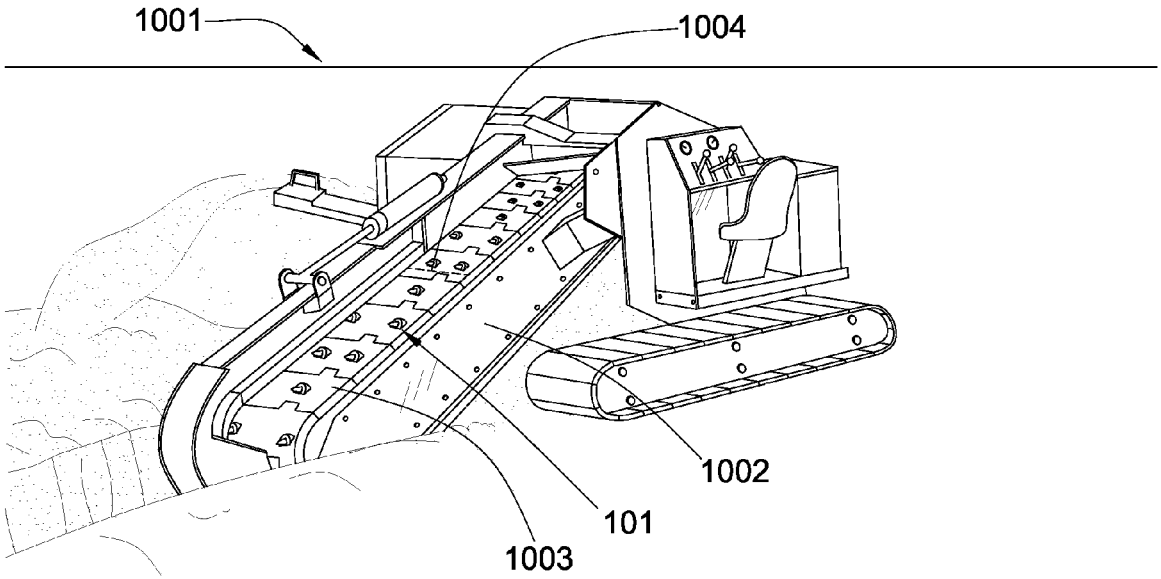
FIG. 9 is a perspective diagram of an embodiment of a trenching machine.
Figure 10:
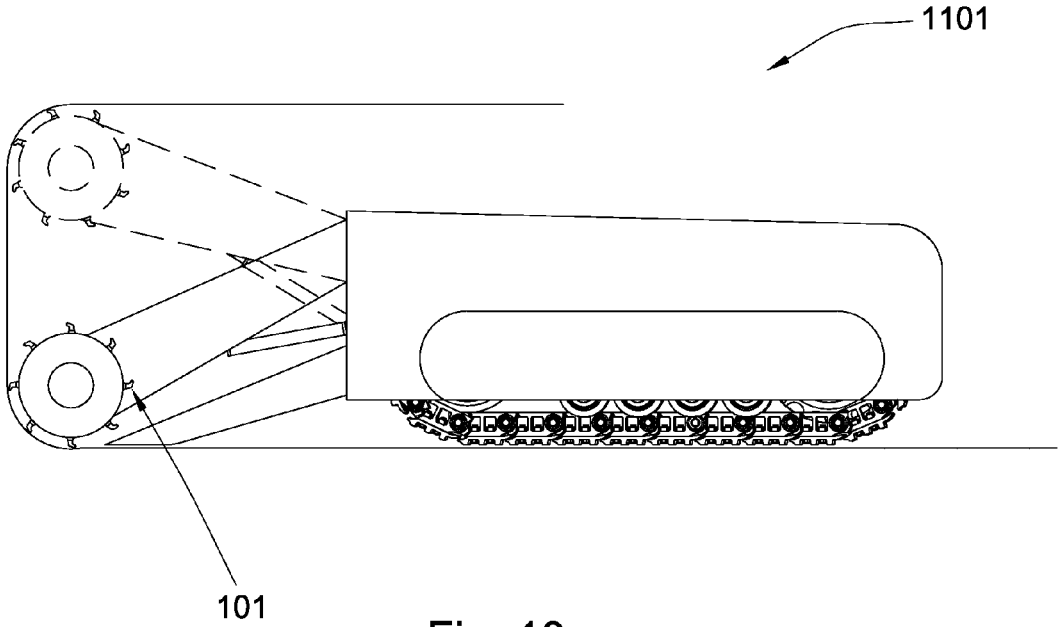
FIG. 10 is an orthogonal diagram of an embodiment of a mining machine.

Degradation assemblies 101 may be used in various applications. Degradation assemblies 101 may be disposed in an asphalt milling machine 103, as in the embodiment of FIG. 1. FIGS. 9 and 10 disclose other high-wear applications that may incorporate the present invention. Degradation assemblies 101 may be used in a trenching machine 1001, as is disclosed in FIG. 9. The degradation assemblies 101 may be placed on a chain 1003 that rotates around an arm 1002 of a chain trenching machine 1001. The degradation assemblies 101 may be disposed in a V-pattern on the chain, but other patterns may be used. Degradation assemblies 101 may also be disposed on a rock wheel trenching machine, or other type of trenching machine. FIG. 10 discloses a mining machine 1101 incorporated with degradation assemblies 101. Other applications that involve intense wear of machinery may also benefit from the incorporation of the present invention Milling machines, for example, may experience wear as they are used to reduce the size of material such as rocks, grain, trash, natural resources, chalk, wood, tires, metal, cars, tables, couches, coal, minerals, chemicals, or other natural resources. Various mills that may incorporate the composite material include mulchers, vertical shaft mills, hammermills, cone crushers, chisels, jaw crushers, or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a holder attached to a driving mechanism and comprising a longitudinal central bore;

a pick comprising a body intermediate a shank and an impact tip, the shank being disposed in the central bore of the holder;

the impact tip comprising diamond; and a bearing assembly with at least one rolling element disposed intermediate a central bore surface and the shank;

wherein the shank is retained in the holder by a resilient keeper ring.

2. The degradation assembly of claim 1, wherein the degradation assembly is part of an asphalt milling machine, a trenching machine, a mining machine, or combinations thereof.

3. The degradation assembly of claim 1, wherein the diamond surface comprises diamond, polycrystalline diamond, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

4. The degradation assembly of claim 1, wherein the bearing assembly is adapted to accommodate radial forces, axial forces, forces perpendicular to a main axis of the holder, or combinations thereof.

5. The degradation assembly of claim 1, wherein the bearing assembly comprises a lubricant.

6. The degradation assembly of claim 5, wherein the lubricant is substantially retained within the bearing assembly.

7. The degradation assembly of claim 1, wherein a bearing assembly is press fit into the bore.

8. The degradation assembly of claim 1, wherein the bearing assembly comprises a taper proximate an intersection of the body and the shank.

9. The degradation assembly of claim 1, wherein the impact tip is disposed on a carbide core that is press fit into a cavity in the body.

10. The degradation assembly of claim 1, wherein the rolling element is a roller bearing, a ball bearing, needle bearing, a spindle bearing, or combinations thereof.

11. The degradation assembly of claim 1, wherein the shank is retained in the holder by a spring-loaded protrusion in the bore of the holder.

12. The degradation assembly of claim 1, wherein a seal proximate the open end of the bore comprises a washer, which is restricted from movement around a central axis of the pick by an o-ring or by a flexible elastomeric substance.

13. The degradation assembly of claim 1, wherein at least one seal proximate the open end of the bore substantially excludes degradation debris from contact with the bearing element.

14. A pick holder, comprising:

a longitudinal central bore with an opening at a distal end of the holder;

an attachment to a driving mechanism at a proximal end of the holder;

a bearing assembly disposed within the central bore;

the bearing assembly comprising a plurality of rolling elements disposed intermediate an outer diameter and an inner diameter;

wherein the bearing assembly is adapted to allow low-friction rotation with respect to the central bore of a shank disposed within the inner diameter; wherein the shank is retained in the holder by a resilient keeper ring.

15. A degradation assembly, comprising:

a holder attached to a driving mechanism and comprising a longitudinal central bore;

a pick comprising a body intermediate a shank and an impact tip, the shank being disposed in the central bore of the holder;

the impact tip comprising a diamond or cubic boron nitride surface; and a bearing assembly disposed within the bore and around the shank;

wherein the bearing assembly is adapted for low-friction rotation with respect to both the bore and the shank; wherein the shank is retained in the holder by a resilient keeper ring.

* * * * *